US010946673B2

(12) United States Patent
Tanabe et al.

(10) Patent No.: US 10,946,673 B2
(45) Date of Patent: Mar. 16, 2021

(54) SURFACE DRYING DEVICE FOR SHEET-LIKE NON-PERMEABLE BASE MATERIAL, PRINTING APPARATUS, AND PRINTING METHOD

(71) Applicant: THINK LABORATORY CO., LTD., Chiba (JP)

(72) Inventors: Shigeki Tanabe, Saitama (JP); Kaku Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 0 days.

(21) Appl. No.: 16/480,656

(22) PCT Filed: Jan. 10, 2018

(86) PCT No.: PCT/JP2018/000237

§ 371 (c)(1),
(2) Date: Jul. 24, 2019

(87) PCT Pub. No.: WO2018/139189

PCT Pub. Date: Aug. 2, 2018

(65) Prior Publication Data

US 2019/0344587 A1 Nov. 14, 2019

(30) Foreign Application Priority Data

Jan. 25, 2017 (JP) ..... JP2017-010819

(51) Int. Cl.
*B41J 11/00* (2006.01)
*B41M 5/00* (2006.01)
*B41M 5/50* (2006.01)

(52) U.S. Cl.
CPC ..... *B41J 11/002* (2013.01); *B41M 5/0017* (2013.01); *B41M 5/502* (2013.01)

(58) Field of Classification Search
CPC .... B41J 3/4078; B41J 11/0015; B41J 11/002; C09D 11/54; C09D 11/033; C09D 11/037;
(Continued)

(56) References Cited

U.S. PATENT DOCUMENTS 2,226,319 A 12/1940 Offen
5,606,805 A 3/1997 Meyer
(Continued)

FOREIGN PATENT DOCUMENTS

CN 1294008 C 1/2007
CN 102133807 A 7/2011
(Continued)

OTHER PUBLICATIONS

Kazuyoshi Ueda, "Humidity and Evaporation—From Basic to Measurement Technology" Corona, 2000.

*Primary Examiner* — Jason S Uhlenhake
(74) *Attorney, Agent, or Firm* — McGlew and Tuttle, P.C.

(57) ABSTRACT

Provided are a surface drying device for a sheet-like non-permeable base material with enhanced drying efficiency on a surface of a sheet-like non-permeable base material having a liquid adhering to a surface thereof, and a printing apparatus and a printing method using the surface drying device. The surface drying device for a sheet-like non-permeable base material includes: a loading port for loading a sheet-like non-permeable base material with a liquid adhering surface; an air nozzle configured to spray high-temperature air; an unloading port for unloading the sheet-like non-permeable base material; an air shield zone forming portion, which is formed between the loading port and the unloading port, and is configured to form a heat-insulating air shield so as to cover the liquid adhering surface of the sheet-like non-permeable base material; and a retained air exhaust portion configured to exhaust retained air retained on the
(Continued)

liquid adhering surface of the sheet-like non-permeable base material to outside of the air shield zone forming portion through use of a Coanda effect, to thereby replace liquid adhering surface air on the liquid adhering surface of the sheet-like non-permeable base material.

20 Claims, 6 Drawing Sheets

(58) Field of Classification Search
CPC ..... C09D 11/322; D06P 3/52; D06P 5/002; D06P 5/30; B41M 5/0017; B41M 5/502
See application file for complete search history.

(56) References Cited

U.S. PATENT DOCUMENTS

| | | | | |
|---|---|---|---|---|
| 2012/0249703 | A1 | | 10/2012 | Nishimura |
| 2016/0332462 | A1 | * | 11/2016 | Harayama ..... B41J 11/0015 |

FOREIGN PATENT DOCUMENTS

| | | | | | |
|---|---|---|---|---|---|
| CN | 102656106 | A | | 9/2012 | |
| CN | 102729658 | A | | 10/2012 | |
| CN | 103660659 | A | | 3/2014 | |
| CN | 103909728 | A | | 7/2014 | |
| CN | 205634374 | U | | 10/2016 | |
| EP | 0003414 | A2 | | 8/1979 | |
| EP | 1592921 | A2 | | 11/2005 | |
| EP | 2407310 | A2 | | 1/2012 | |
| EP | 2505368 | A1 | | 10/2012 | |
| EP | 3093148 | A1 | | 11/2016 | |
| GB | 489819 | A | | 8/1938 | |
| IT | MI20030273 | A1 | | 8/2004 | |
| JP | H062093 | U | | 1/1994 | |
| JP | 2002166667 | A | | 6/2002 | |
| JP | 2005-265271 | A | | 9/2005 | |
| JP | 2007-253613 | A | | 10/2007 | |
| JP | 2012-206303 | A | | 10/2012 | |
| JP | 2012-528750 | A | | 11/2012 | |
| JP | 2013-166258 | A | | 8/2013 | |
| JP | 2014-129909 | A | | 7/2014 | |
| JP | 2016-186377 | A | | 10/2016 | |
| JP | 2016186377 | A | * | 10/2016 | |
| JP | 2016-210959 | A | | 12/2016 | |
| JP | 2016-215428 | A | | 12/2016 | |
| KR | 10-2012-0112181 | A | | 10/2012 | |
| KR | 20160150561 | A | | 12/2016 | |
| WO | 2004/072552 | A2 | | 8/2004 | |
| WO | WO-2004072552 | A2 | * | 8/2004 | ..... F26B 13/10 |

* cited by examiner

SURFACE DRYING DEVICE FOR SHEET-LIKE NON-PERMEABLE BASE MATERIAL, PRINTING APPARATUS, AND PRINTING METHOD

TECHNICAL FIELD

The present invention relates to a surface drying device for a sheet-like non-permeable base material having a liquid such as paint or ink adhering to a surface thereof, and a printing apparatus and a printing method using the surface drying device for a sheet-like non-permeable base material.

BACKGROUND ART

As seen in the use of aqueous ink on a sheet-like non-permeable base material, a drying system based on evaporation of a solvent is a technology which has recently drawn attention in fields of, for example, one-pass (single-pass) aqueous ink jet printing, transfer of liquid toner and aqueous ink jet, and aqueous gravure printing.

In drying of the sheet-like non-permeable base material by evaporation, drying energy is large, and hence measures have been taken from various aspects. There are given, for example, a device of a type dependent on an anchor coat of a base material and the improvement of condensation viscosity of a material, a device of a type dependent on the circulation recovery of a special solvent, and a device of a type dependent on the increase in length of a drying device and the improvement of power. A device for efficient evaporation drying of a solvent on a non-permeable base material, which is not dependent on a material or a solvent, is required.

In evaporation drying, it is important to increase the temperature of a material by local heating and remove an evaporated solvent on the periphery of the material. Further, unlike a uniform coated material, a printed matter and the like have a problem in that a solvent, a coloring agent, and the like contained in ink are not uniformly distributed on a printed surface, and hence drying is not uniformly performed.

In Patent Document 1 and Patent Document 2, as examples of the increase in temperature by local heating, there have been proposed examples using a microwave and an IR heating system. Further, in Patent Document 3, there has been proposed an example using drying through a horizontal air stream in an ink jet printing apparatus. In Patent Document 4, there has been proposed an example of solving the problem of non-uniformity of printed ink through use of infrared electromagnetic energy and a convective air flow. However, those proposals are insufficient in terms of energy to be used and compactness from the viewpoint of efficient drying for a non-permeable base material.

PRIOR ART DOCUMENT

Patent Document

Patent Document 1: JP 2005-265271 A
Patent Document 2: JP 2014-129909 A
Patent Document 3: JP 2007-253613 A
Patent Document 4: JP 2012-528750 A

SUMMARY OF THE INVENTION

Problems to be Solved by the Invention

The present invention has been made in view of the above-mentioned problems of the related art, and an object of the present invention is to provide a surface drying device for a sheet-like non-permeable base material with enhanced drying efficiency on a surface of a sheet-like non-permeable base material having a liquid adhering to a surface thereof, and a printing apparatus and a printing method using the surface drying device for a sheet-like non-permeable base material.

Means for Solving Problems

In order to solve the problems described above, according to one aspect of the present invention, there is provided a surface drying device for a sheet-like non-permeable base material, including: a loading port for loading a sheet-like non-permeable base material with a liquid adhering surface having a liquid adhering to a surface thereof; an air nozzle configured to spray high-temperature air onto the liquid adhering surface of the loaded sheet-like non-permeable base material; an unloading port for unloading the sheet-like non-permeable base material; an air shield zone forming portion, which is formed between the loading port and the unloading port, and is configured to form a heat-insulating air shield so as to cover the liquid adhering surface of the sheet-like non-permeable base material; and a retained air exhaust portion, which is formed in the air shield zone forming portion, and is configured to exhaust retained air retained on the liquid adhering surface of the sheet-like non-permeable base material to outside of the air shield zone forming portion through use of a Coanda effect, to thereby replace liquid adhering surface air on the liquid adhering surface of the sheet-like non-permeable base material.

It is preferred that the surface drying device further includes a warming mechanism configured to warm the sheet-like non-permeable base material from a back surface side of the sheet-like non-permeable base material.

According to one aspect of the present invention, there is provided a printing apparatus, including the said surface drying device for a sheet-like non-permeable base material so as to dry an ink adhering surface of a sheet-like non-permeable base material having ink adhering thereto.

According to one aspect of the present invention, there is provided a printing method, including a step of drying an ink adhering surface of a sheet-like non-permeable base material having ink adhering thereto by the said surface drying device for a sheet-like non-permeable base material.

According to one aspect of the present invention, there is provided a printed matter, which is printed by the said printing method, and in which an ink adhering surface of a sheet-like non-permeable base material having ink adhering thereto is dried.

Advantageous Effects of the Invention

According to the present invention, there can be attained a significant effect of being capable of providing a surface drying device for a sheet-like non-permeable base material with enhanced drying efficiency on a surface of a sheet-like non-permeable base material having a liquid adhering to a surface thereof, and a printing apparatus and a printing method using the surface drying device for a sheet-like non-permeable base material.

DESCRIPTION OF EMBODIMENTS

Now, embodiments of the present invention are described. However, the embodiments are described only for illustrative purposes, and needless to say, the embodiments can be modified without departing from the technical concept of the present invention. Like members are denoted by like reference symbols.

A surface drying device for a sheet-like non-permeable base material according to the present invention is suitably used in a transfer system, a printing system, and the like, which are required to have a relatively high speed, for example, one-pass (single-pass) aqueous ink jet printing, transfer of liquid toner and aqueous ink jet, aqueous flexographic printing, and aqueous gravure printing in the sheet-like non-permeable base material. The surface drying device for a sheet-like non-permeable base material according to the present invention is a drying device in which radiation, convection, and conduction of heat are combined, and in which an air shield with respect to a dry medium is used. In this surface drying device for a sheet-like non-permeable base material, a solvent retained in the vicinity of a surface boundary of the dry medium is efficiently discharged and replaced through use of a Coanda effect in the air shield, to thereby enhance drying efficiency.

In the surface drying device for a sheet-like non-permeable base material according to the present invention, there is proposed a device configured to perform efficient evaporation drying of a solvent in a non-permeable base material without depending on a material for a liquid such as paint or ink and a solvent which are caused to adhere to a surface.

Further, in order to incorporate the surface drying device into a one-pass ink jet apparatus, the device is required to be small. Further, in order to reduce the influence of heat on an ink jet head, it is also required that the surface drying device and the ink jet head be separated from each other. In the case of assuming printing, it is also required to take measures against non-uniform drying caused by non-uniform localization of ink. Still further, in order to take measures against thermal deformation of the sheet-like non-permeable base material, it is also required to be able to freely control a temperature increase in accordance with the speed of a line. The surface drying device according to the embodiment of the present invention is a device that fulfills all the above-mentioned requirements.

Figure 1:
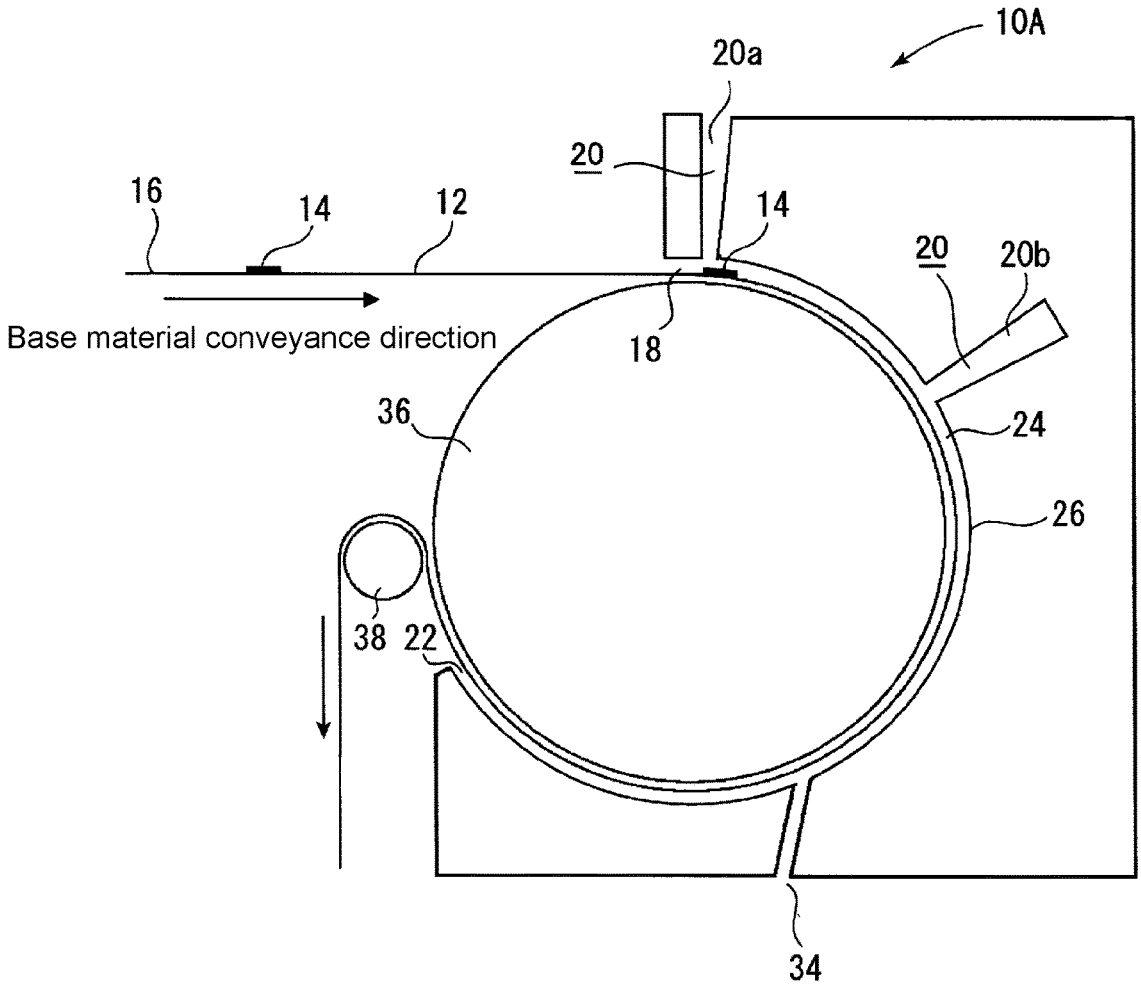
FIG. 1 is a schematic side view for illustrating one embodiment of a surface drying device for a sheet-like non-permeable base material according to the present invention.
Figure 2:
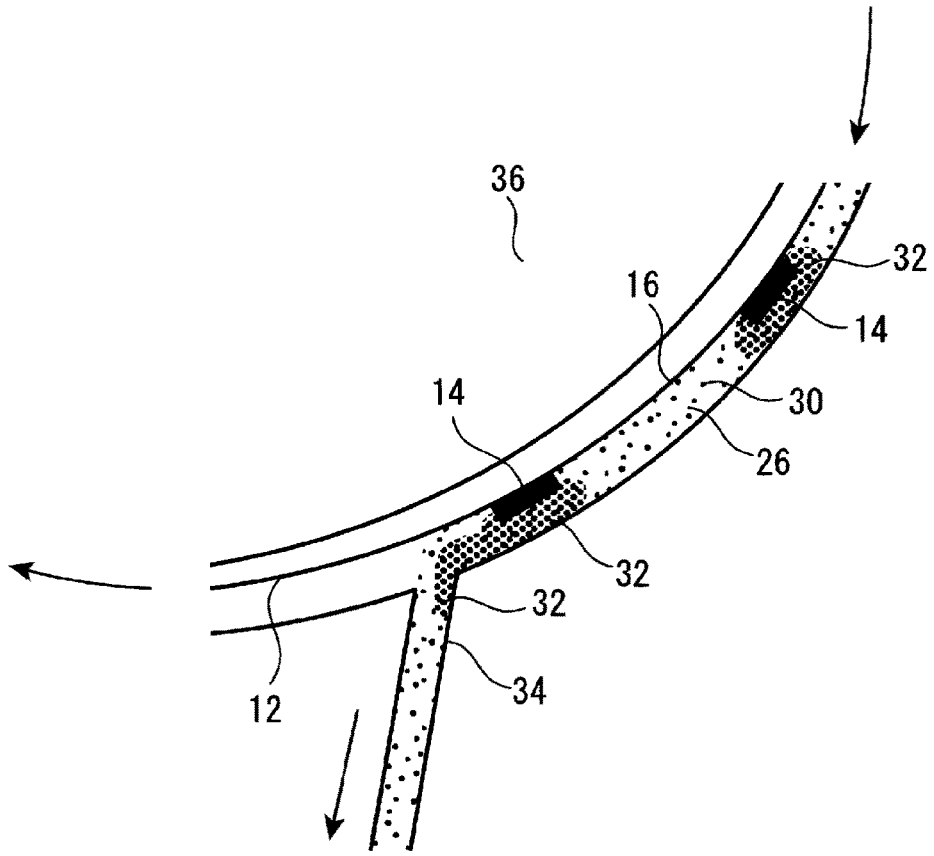
FIG. 2 is an enlarged view of main parts of FIG. 1.
Figure 3:
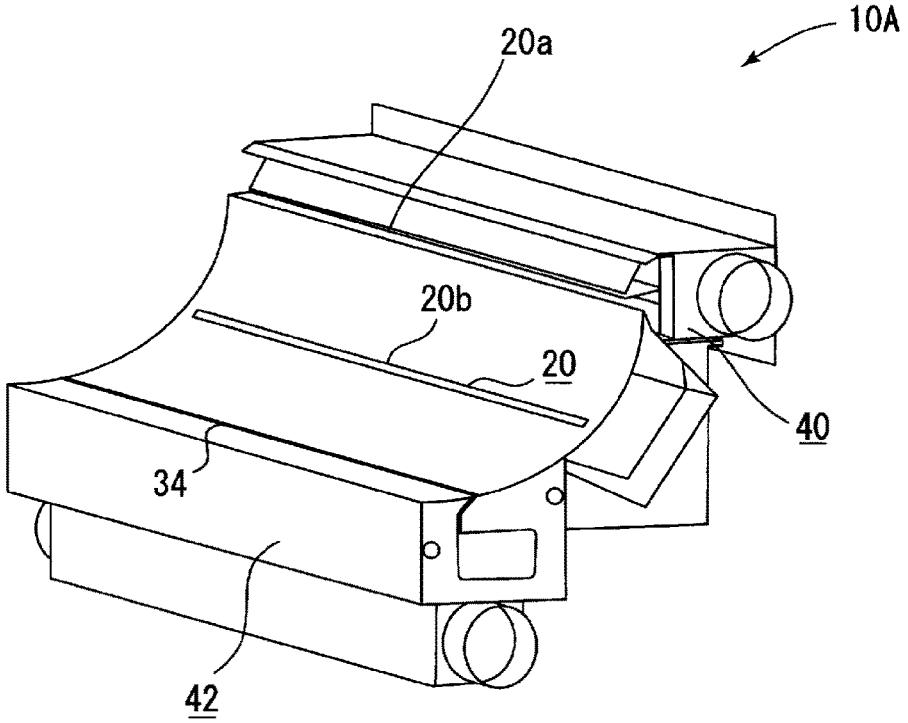
FIG. 3 is a schematic perspective view for more specifically illustrating the embodiment illustrated in FIG. 1.

One embodiment of the present invention is illustrated in FIG. 1 to FIG. 3. In FIG. 1 to FIG. 3, there is illustrated a surface drying device 10A for a sheet-like non-permeable base material according to the present invention. The surface drying device 10A includes a loading port 18, an air nozzle 20, an unloading port 22, and an air shield zone forming portion 26. The loading port 18 is used for loading a sheet-like non-permeable base material 16 with a liquid adhering surface 14 having a liquid such as paint or ink adhering to a surface 12. The air nozzle 20 is configured to spray high-temperature air onto the liquid adhering surface 14 of the loaded sheet-like non-permeable base material 16. The unloading port 22 is used for unloading the sheet-like non-permeable base material 16. The air shield zone forming portion 26 is formed between the loading port 18 and the unloading port 22, and is configured to form a heat-insulating air shield 24 so as to cover the liquid adhering surface 14 of the sheet-like non-permeable base material 16. As the sheet-like non-permeable base material 16, an example using a polyethylene terephthalate (PET) resin film is illustrated. The sheet-like non-permeable base material 16 is a sheet-like non-permeable base material that has a web shape and flexibility.

As is well illustrated in FIG. 1 and FIG. 2, the surface drying device 10A further includes a retained air exhaust portion 34. The retained air exhaust portion 34 is formed in the air shield zone forming portion 26, and is configured to exhaust retained air 30 retained on the liquid adhering surface 14 of the sheet-like non-permeable base material 16 to outside of the air shield zone forming portion 26 through use of the Coanda effect, to thereby replace liquid adhering surface air 32 on the liquid adhering surface 14 of the sheet-like non-permeable base material 16.

As the temperature of the high-temperature air sprayed from the air nozzle 20 onto the liquid adhering surface 14 of the sheet-like non-permeable base material 16, a temperature of from 50° C. to 150° C. is preferred. Further, there is illustrated an example in which the air nozzles 20 are provided at two positions, which are a first air nozzle 20*a* and a second air nozzle 20*b*, respectively. A plurality of air nozzles 20 may be provided, and there is no particular limitation on the number of the air nozzles 20 to be installed. As the liquid such as paint or ink, a liquid, for example, aqueous paint or ink is preferred. The liquid such as paint or ink may contain a solvent medium.

There are illustrated a rotary cylinder 36 and a feed roll 38. The rotary cylinder 36 includes a warming mechanism. As an example of the warming mechanism provided in the rotary cylinder, there is given, for example, a warming mechanism having a configuration illustrated in FIG. 9 as described later. The sheet-like non-permeable base material 16 is conveyed along the rotary cylinder 36 and taken up onto a take-up roll (not shown) through intermediation of the feed roll 38. The rotary cylinder 36 is a cylinder body that is rotated by drive means (not shown), and the sheet-like non-permeable base material 16 is conveyed on the rotary cylinder 36.

The first air nozzle 20*a* and the second air nozzle 20*b* are mounted on an air jetting device 40, and are configured to spray the high-temperature air at a temperature of, for example, from about 50° C. to about 150° C. onto the liquid adhering surface 14 of the loaded sheet-like non-permeable base material 16. In the illustrated example, in a region defined by the air jetting device 40 and the rotary cylinder 36, a portion on a most upstream side forms the loading port 18. In the air jetting device 40, a temperature control device for air to be sprayed is provided.

Further, the retained air exhaust portion 34 is mounted on an air suction device 42. The retained air 30 retained on the liquid adhering surface 14 of the sheet-like non-permeable base material 16 is exhausted to outside of the air shield zone forming portion 26 through the Coanda effect. In the illustrated example, in a region defined by the air suction device 42 and the rotary cylinder 36, a portion on a most downstream side forms the unloading port 22.

A region between the loading port 18 and the unloading port 22 serves as the air shield zone forming portion 26 configured to form the heat-insulating air shield 24 so as to cover the liquid adhering surface 14 of the sheet-like non-permeable base material 16. In the illustrated example, a region defined by the air jetting device 40, the air suction device 42, and the rotary cylinder 36 serves as the air shield zone forming portion 26 configured to form the heat-insulating air shield 24.

In FIG. 3, the embodiment illustrated in FIG. 1 is more specifically illustrated. In the illustration of FIG. 3, the air shield zone forming portion 26 is shorter than the air shield zone forming portion 26 of FIG. 1. However, the basic configuration of FIG. 3 is the same as that of the embodiment illustrated in FIG. 1.

The surface drying device for a sheet-like non-permeable base material according to the present invention includes an air shield, which is heat-insulated, in order to make drying efficient and reduce the influence of heat on other portions. Further, in order to take measures against non-uniform drying caused by non-uniform localization of a liquid such as ink caused to adhere to a surface, a conduction and convection portion using a high-temperature air nozzle is provided. Further, a heating portion using an electromagnetic wave may be provided in order to perform a local high-speed temperature increase. Further, in order to efficiently perform removal and replacement of a solvent that is evaporated and convected to a final portion, an exhaust portion configured to perform exhaust through use of the Coanda effect is provided. The three constituent portions such as the conduction and convection portion, the heating portion, and the exhaust portion in the air shield can optimally keep a dried state by independently controlling each temperature and air volume, an electromagnetic output, and an exhaust air volume.

Through use of the surface drying device 10A for a sheet-like non-permeable base material having the above-mentioned configuration, the drying efficiency on the surface of the sheet-like non-permeable base material 16 having a liquid such as paint or ink adhering to the surface 12 can be enhanced.

Figure 4:
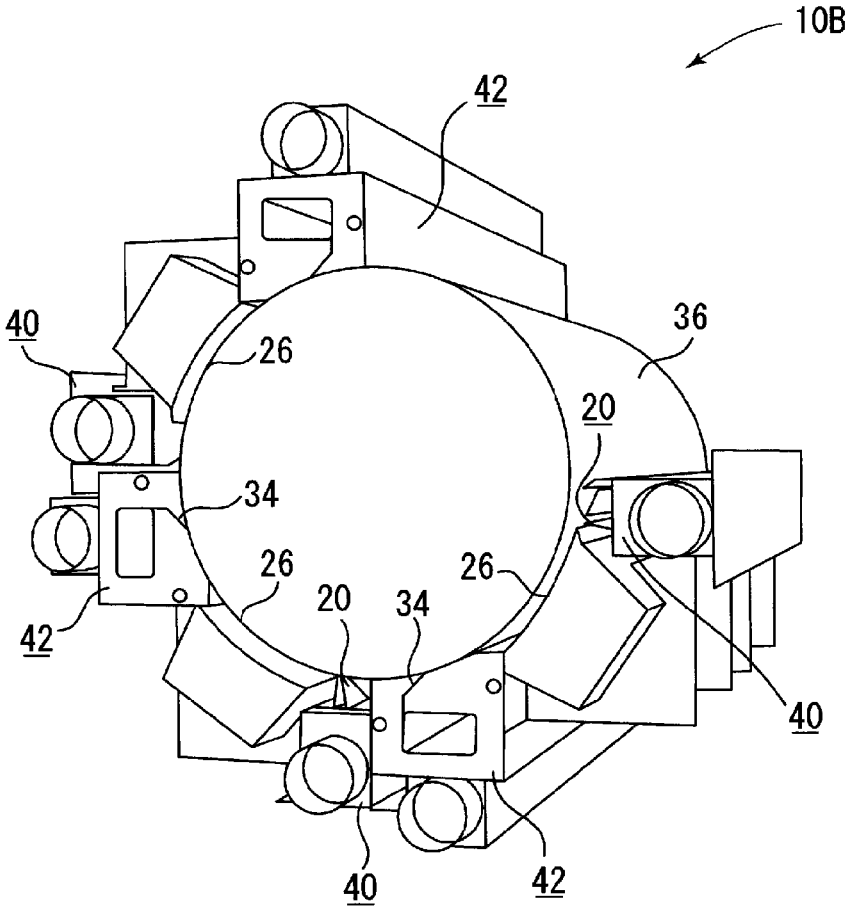
FIG. 4 is a schematic perspective view for illustrating an embodiment in which there are provided a plurality of surface drying devices for a sheet-shaped non-permeable base material illustrated in FIG. 3.

Next, an embodiment in which there are provided a plurality of surface drying devices 10A illustrated in FIG. 3 is illustrated in FIG. 4.

As illustrated in FIG. 4, a surface drying device 10B for a sheet-like non-permeable base material according to the present invention is an embodiment in which there are provided a plurality of surface drying devices 10A for a sheet-like non-permeable base material illustrated in FIG. 3. In the surface drying device 10B, there are provided a plurality of (three in the illustrated example) air jetting devices 40 each having the air nozzle 20, which includes the first air nozzle 20*a* and the second air nozzle 20*b*, mounted thereon. Further, there are similarly provided a plurality of (three in the illustrated example) air suction devices 42 each having the retained air exhaust portion 34 mounted thereon. That is, the surface drying device 10B has a configuration in which three surface drying devices 10A illustrated in FIG. 3 are provided on a circumferential surface of the rotary cylinder 36. Therefore, the surface drying device 10B can obtain additive drying ability as compared to the surface drying device 10A.

When the surface drying device for a sheet-like non-permeable base material according to the present invention described above is provided in a printing apparatus, the printing apparatus is imparted with significantly satisfactory drying efficiency on an ink adhering surface of a sheet-like non-permeable base material having ink adhering thereto.

Further, when printing is performed in various manners, the surface drying device for a sheet-like non-permeable base material is provided, and the step of drying the ink adhering surface of the sheet-like non-permeable base material having ink adhering thereto is performed. With this, a printing method is imparted with significantly satisfactory drying efficiency on the ink adhering surface of the sheet-like non-permeable base material having ink adhering thereto. A printed matter printed by such printing method becomes a printed matter in which the ink adhering surface of the sheet-like non-permeable base material having ink adhering thereto is dried significantly efficiently.

Figure 5:
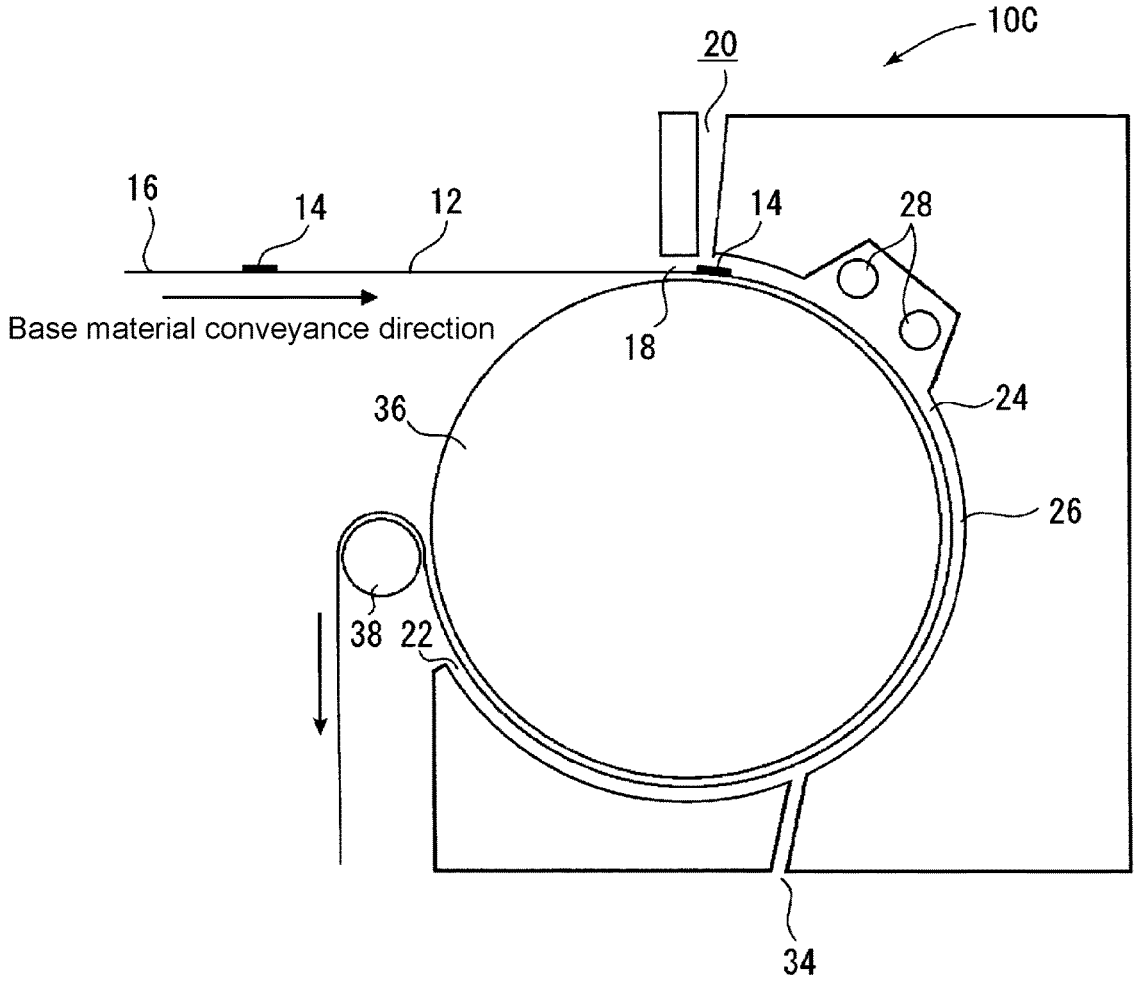
FIG. 5 is a schematic side view for illustrating another embodiment of a surface drying device for a sheet-shaped non-permeable base material according to the present invention.
Figure 6:
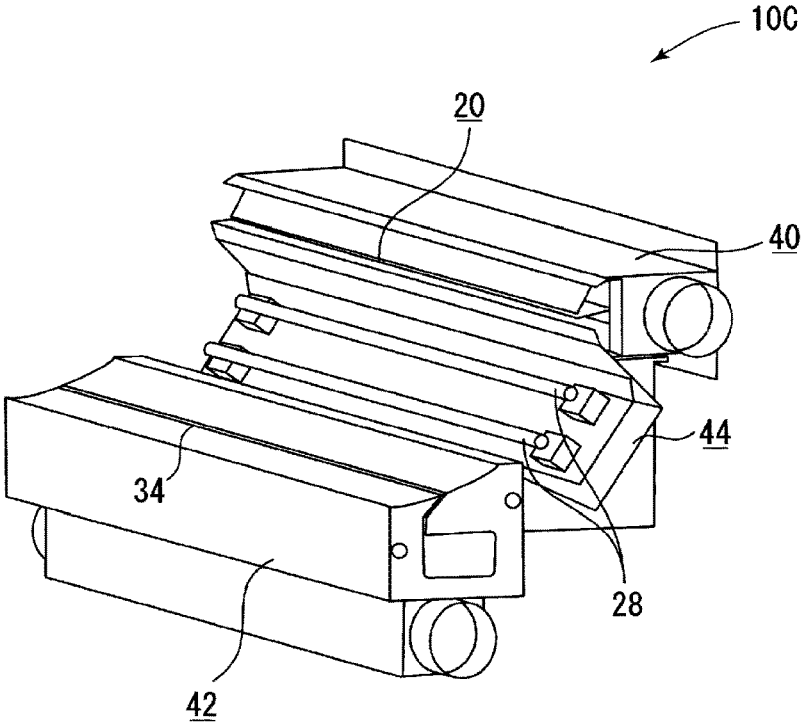
FIG. 6 is a schematic perspective view for more specifically illustrating the embodiment illustrated in FIG. 5.

FIG. 5 and FIG. 6 are each a view for illustrating a surface drying device for a sheet-like non-permeable base material according to another embodiment of the present invention.

In FIG. 5 and FIG. 6, there is illustrated a surface drying device 10C for a sheet-like non-permeable base material according to the present invention. The surface drying device 10C includes the loading port 18, the air nozzle 20, the unloading port 22, the air shield zone forming portion 26, and a radiative heating portion 28. The loading port 18 is used for loading the sheet-like non-permeable base material 16 with the liquid adhering surface 14 having a liquid such as paint or ink adhering to the surface 12. The air nozzle 20 is configured to spray high-temperature air onto the liquid adhering surface 14 of the loaded sheet-like non-permeable base material 16. The unloading port 22 is used for unloading the sheet-like non-permeable base material 16. The air shield zone forming portion 26 is formed between the loading port 18 and the unloading port 22, and is configured to form the heat-insulating air shield 24 so as to cover the liquid adhering surface 14 of the sheet-like non-permeable base material 16. The radiative heating portion 28 is provided in the air shield zone forming portion 26, and is configured to irradiate the liquid adhering surface 14 of the sheet-like non-permeable base material 16 with radiation heat. As the sheet-like non-permeable base material 16, an example using a polyethylene terephthalate (PET) resin film is illustrated. The sheet-like non-permeable base material 16 is a sheet-like non-permeable base material that has a web shape and flexibility.

As is well illustrated in FIG. 5 and FIG. 6, the surface drying device 10C also includes the retained air exhaust portion 34. The retained air exhaust portion 34 is formed in the air shield zone forming portion 26, and is configured to exhaust the retained air 30 retained on the liquid adhering surface 14 of the sheet-like non-permeable base material 16 to outside of the air shield zone forming portion 26 through the Coanda effect, to thereby replace liquid adhering surface air 32 on the liquid adhering surface 14 of the sheet-like non-permeable base material 16. That is, in the surface drying device 10C, in place of the second air nozzle 20*b* in the surface drying device 10A illustrated in FIG. 3, the radiative heating portion 28 configured to irradiate the liquid adhering surface 14 of the sheet-like non-permeable base material 16 with radiation heat are provided in the air shield zone forming portion 26. In the illustrated example, the air nozzle 20 is provided on an upstream side from the radiative heating portion 28, but the air nozzle 20 may be provided on a downstream side from the radiative heating portion 28.

The radiative heating portion 28 configured to irradiate the liquid adhering surface 14 of the sheet-like non-permeable base material 16 with radiation heat is mounted on a radiative heating device 44. As an example of the radiative heating portion 28 of the radiative heating device 44, an example of infrared heating through use of a halogen lamp light source is illustrated. Any heating means can be used as the radiative heating portion 28 as long as it is possible to perform radiative heating. Besides infrared heating through use of a lamp other than the halogen lamp, heating means such as electromagnetic heating, for example, microwave heating can also be used. Further, a temperature control device configured to regulate the temperature of the radiative heating portion 28 is provided in the radiative heating device 44.

Figure 7:
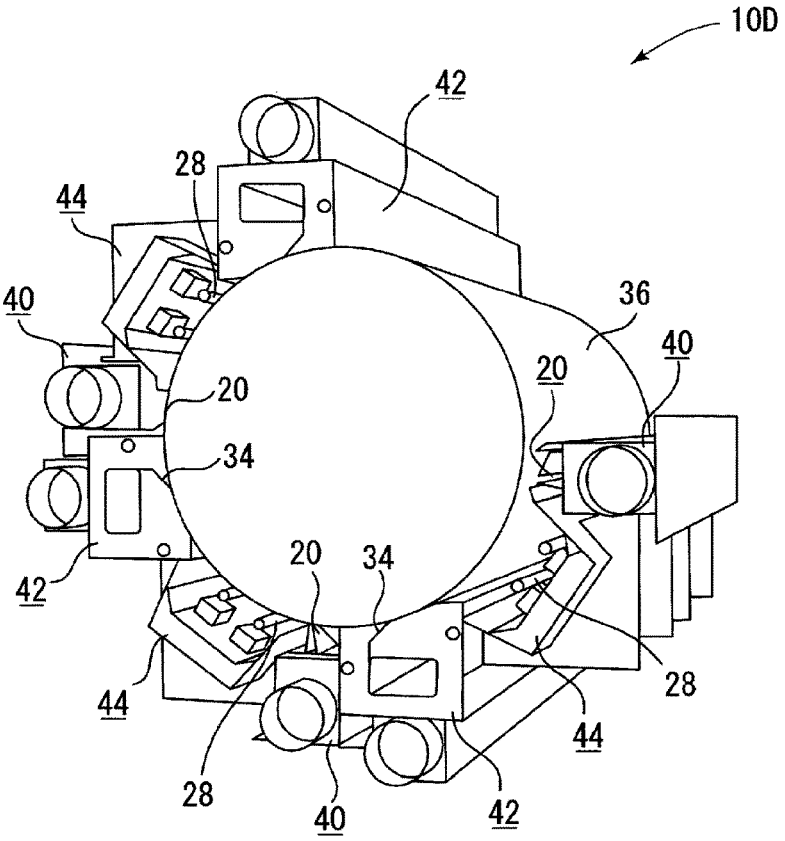
FIG. 7 is a schematic perspective view for illustrating an embodiment in which there are provided a plurality of surface drying devices for a sheet-like non-permeable base material illustrated in FIG. 6.

Next, an embodiment in which there are provided a plurality of surface drying devices 10C illustrated in FIG. 6 is illustrated in FIG. 7.

As illustrated in FIG. 7, a surface drying device 10D for a sheet-like non-permeable base material according to the present invention is an embodiment in which there are provided a plurality of surface drying devices 10C for a sheet-like non-permeable base material illustrated in FIG. 6. In the surface drying device 10D, there are provided a plurality of (three in the illustrated example) air jetting devices 40 each having the air nozzle 20. Further, there are similarly provided a plurality of (three in the illustrated example) air suction devices 42 each having the retained air exhaust portion 34 mounted thereon. Further, there are similarly provided a plurality of (three in the illustrated example) radiative heating devices 44 each having the radiative heating portion 28 mounted thereon. That is, the surface drying device 10D has a configuration in which three surface drying devices 10C illustrated in FIG. 6 are provided on a circumferential surface of the rotary cylinder 36. Therefore, the surface drying device 10D can obtain additive drying ability as compared to the surface drying device 10C.

It is preferred that the surface drying device for a sheet-like non-permeable base material according to the present invention further include a warming mechanism configured to warm the sheet-like non-permeable base material 16 from a back surface side of the sheet-like non-permeable base material 16. This is because drying efficiency is enhanced.

Figure 8:
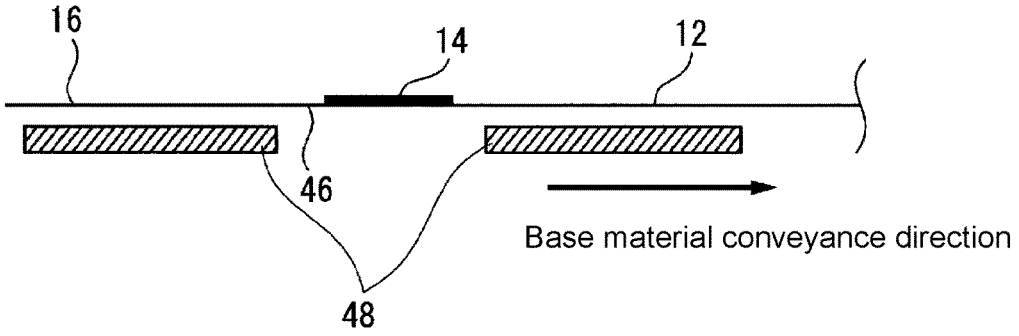
FIG. 8 is a schematic side view of main parts for illustrating an embodiment of a warming mechanism configured to warm the sheet-like non-permeable base material from a back surface side of the sheet-like non-permeable base material.
Figure 9:
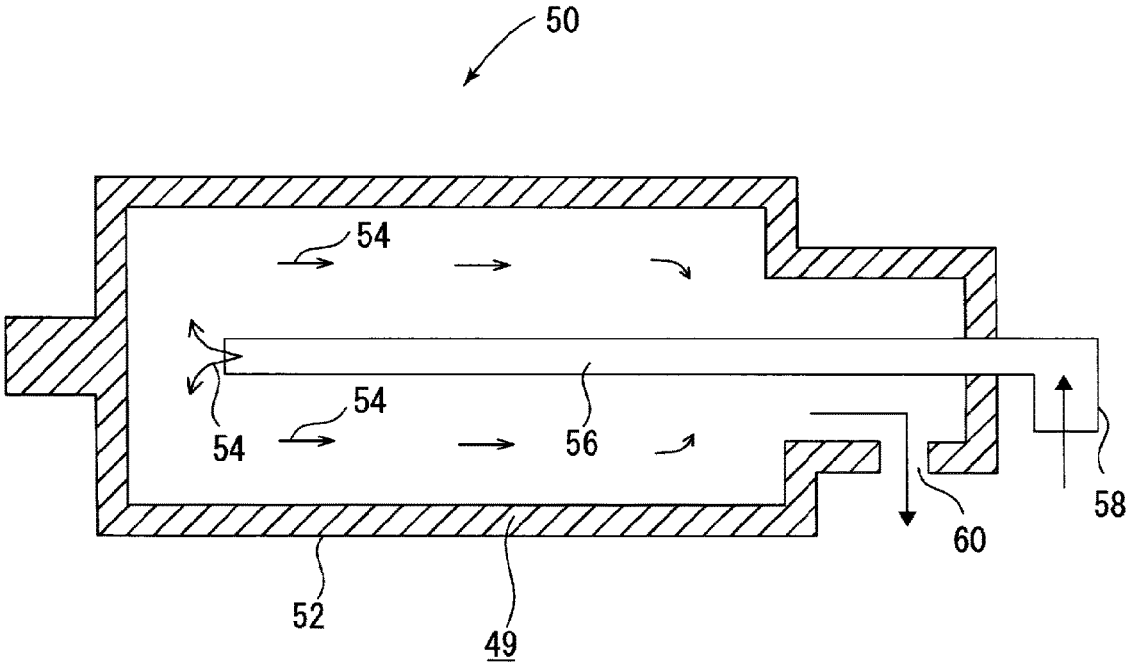
FIG. 9 is a schematic explanatory side sectional view of main parts for illustrating another embodiment of the heating mechanism configured to warm the sheet-like non-permeable base material from a back surface side of the sheet-like non-permeable base material.

FIG. 8 and FIG. 9 are each a view for illustrating an example of the warming mechanism configured to warm the sheet-like non-permeable base material 16 from the back surface side of the sheet-like non-permeable base material 16. As illustrated in FIG. 8, a warming mechanism 48 configured to warm the sheet-like non-permeable base material 16 from a back surface side 46 of the sheet-like non-permeable base material 16 can be provided. In the warming mechanism 48 of FIG. 8, an example of an electrothermal panel is illustrated. As the electrothermal panel, a known electrothermal panel can be used. As the warming mechanism 48 configured to warm the sheet-like non-permeable base material 16 from the back surface side 46 of the sheet-like non-permeable base material 16, it is only required that the sheet-like non-permeable base material 16 be warmed from the back surface side 46 of the sheet-like non-permeable base material 16. Therefore, various known warming mechanisms can be used.

In FIG. 9, there is illustrated an example of a hot-water circulating type cylinder as a warming mechanism 49 configured to warm the sheet-like non-permeable base material 16 from the back surface side 46 of the sheet-like non-permeable base material 16. In a hot-water circulating type cylinder 50, a hot-water flow passage 56 for causing hot water 54 to flow is formed in a cylinder body 52. The hot water 54 has a temperature of, for example, from 50° C. to 70° C. In a rear end portion of the cylinder body 52, an inflow port 58 and an outflow port 60 for causing inflow and outflow of the hot water 54 are formed. The hot water 54 is circulated with a circulation pump provided outside. When the sheet-like non-permeable base material 16 is conveyed on a rotary cylinder of the hot-water circulating type cylinder 50 configured as described above, the sheet-like non-permeable base material 16 can also be warmed from the back surface side 46 of the sheet-like non-permeable base material 16. As the hot-water circulating type cylinder, a known hot-water circulating type cylinder capable of warming can be used besides the illustrated example.

EXAMPLE

Now, the present invention is more specifically described by way of Examples, but it is needless to say that Examples are only illustrative and should not be interpreted as limiting the present invention.

Example 1

A surface drying device for a sheet-like non-permeable base material as illustrated in FIG. 3 was mounted on a one-pass ink jet printing machine, to thereby provide a printing apparatus including one surface drying device configured to dry an ink adhering surface of a sheet-like non-permeable base material having ink adhering thereto. Thus, an ink adhering surface of a base material printed by the one-pass ink jet printing machine was set to be dried by a roll-to-roll process in the above-mentioned surface drying device in accordance with the principle illustrated in FIG. 1. As the surface drying device for a sheet-like non-permeable base material, the following device was used.

Cylinder: A stainless cylinder having a surface length of 600 mm and a diameter of 300 mm and being adaptable to hot-water circulation was used.

Air nozzle: An air nozzle made of metal having a width of 550 mm in a longitudinal direction of the cylinder and a nozzle width of 3 mm was used, with a first air nozzle having an air irradiation angle of 45 degrees with respect to a cylinder circumferential surface and a second air nozzle having an air irradiation angle of 90 degrees with respect to the cylinder circumferential surface.

Coanda discharge portion: A Coanda discharge portion made of metal having a width of 550 mm in the longitudinal direction of the cylinder and a slit width of 2 mm was used.

Ink: Aqueous ink containing a high-boiling-point solvent medium disclosed in JP 2016-210959 A was used.

Base material: A polyethylene terephthalate (PET) resin film (manufactured by Futamura Chemical Co., Ltd.) having a thickness of 25 μm was used.

Condition of each portion: A cylinder hot water was controlled within a range of from 55° C. to 60° C.; the intake air volume of each air nozzle was set to 3 $m^3$/min and the air outlet temperature thereof was set to 130° C.; and the discharge air volume of the Coanda discharge portion was set to 1 $m^3$/min. As the ink, white ink, which was considered to have a large usage area and to be difficult to be dried, was used. The ejection amount of the ink was set to 20 pl of 600 dpi and evaluated through whole solid printing. Drying was evaluated based on whether or not transfer to a turn roller made of metal located within 500 mm in a back portion of the dried part occurred. This method has been used by those skilled in the printing field as a method most suitable for actual application, and hence this method was adopted.

A linear speed was increased by 1 m/min under the above-mentioned condition, and an optimum value of the discharge air volume of the Coanda portion related to drying ability was determined.

The maximum drying linear speed was 7 m/min in the absence of a Coanda discharge air volume, but the maximum drying linear speed was 10 m/min in the case of the discharge air volume of 1 $m^3$/min under the above-mentioned condition. Thus, the drying ability was enhanced by about 40%. The drying ability was not enhanced even when the discharge air volume was increased or decreased more.

Example 2

The ink adhering surface was set to be dried by a roll-to-roll process under the same condition as that of Example 1 except that three surface drying devices as illustrated in FIG. 4 were mounted on a one-pass ink jet printing machine to provide a printing apparatus. It was confirmed that additive drying ability was able to be evaluated. Further, it was confirmed that this Example was adaptable to a linear speed of 30 m/min under the same condition as that of Example 1.

REFERENCE SIGNS LIST

10A, 10B, 10C, 10D: surface drying device for sheet-like non-permeable base material, 12: surface, 14: liquid adhering surface, 16: sheet-like non-permeable base material, 18: loading port, 20: air nozzle, 20*a*: first air nozzle, 20*b*: second air nozzle, 22: unloading port, 24: heat-insulating air shield, 26: air shield zone forming portion, 28: radiative heating portion, 30: retained air, 32: liquid adhering surface air, 34: retained air exhaust portion, 36: rotary cylinder, 38: feed roll, 40: air jetting device, 42: air suction device, 44: radiative heating device, 46: back surface side of sheet-like non-permeable base material, 48, 49: warming mechanism, 50: hot-water circulating type cylinder, 52: cylinder body, 54: hot water, 56: hot-water flow passage, 58: inflow port, 60: outflow port.

The invention claimed is:

1. A surface drying device for a sheet of non-permeable base material, the surface drying device comprising:

a loading port for loading a sheet of non-permeable base material with an ink adhering surface having an ink adhering to a surface thereof;

an air nozzle configured to spray high-temperature air onto the ink adhering surface of the sheet of non-permeable base material loaded;

an unloading port for unloading the sheet of non-permeable base material;

an air shield zone forming portion, which is formed between the loading port and the unloading port, and the air shield zone forming portion is configured to form a heat-insulating air shield so as to cover the ink adhering surface of the sheet of non-permeable base material;

a retained air exhaust portion, which is formed in the air shield zone forming portion, and the retained air exhaust portion is configured to exhaust retained air retained on the ink adhering surface of the sheet of non-permeable base material to outside of the air shield zone forming portion via a Coanda effect, to thereby replace ink adhering surface air on the ink adhering surface of the sheet non-permeable base material; and a conduction and convection portion provided in the air shield zone forming portion, wherein the retained air exhaust portion is an exhaust portion configured to perform removal and replacement of a solvent that is evaporated and convected to a final portion of the air shield zone forming portion.

2. The surface drying device for the sheet of non-permeable base material according to claim 1, further comprising a warming mechanism configured to warm the sheet of non-permeable base material from a back surface side of the sheet of non-permeable base material.

3. The surface drying device for the sheet of non-permeable base material according to claim 1, wherein the ink is an aqueous ink containing a solvent medium.

4. The surface drying device for the sheet of non-permeable base material according to claim 1, wherein the ink is an aqueous ink containing a high-boiling-point solvent medium.

5. The surface drying device for the sheet of non-permeable base material according to claim 1, further comprising a circumferential surface configured to extend about a circumferential portion of the non-permeable base material in a circumferential direction.

6. The surface drying device for the sheet of non-permeable base material according to claim 5, wherein the retained air exhaust portion is located between the unloading port and the loading port in the circumferential direction.

7. The surface drying device for the sheet of non-permeable base material according to claim 5, wherein the retained air exhaust portion is located between the unloading port and the air nozzle in the circumferential direction.

8. The surface drying device for the sheet of non-permeable base material according to claim 5, wherein the loading port is located at a circumferentially spaced location from the unloading port.

9. A printing apparatus, comprising:

a surface drying device for a sheet of non-permeable base material so as to dry an ink adhering surface of the sheet of non-permeable base material having ink adhering thereto, the surface drying device comprising:

a loading port for loading the sheet of non-permeable base material with a liquid adhering surface having a liquid adhering to a surface thereof;

an air nozzle configured to spray high-temperature air onto the liquid adhering surface of the sheet of non-permeable base material loaded;

an unloading port for unloading the sheet of non-permeable base material;

an air shield zone forming portion, which is formed between the loading port and the unloading port, and the air shield zone forming portion is configured to form a heat-insulating air shield so as to cover the liquid adhering surface of the sheet of non-permeable base material;

a retained air exhaust portion, which is formed in the air shield zone forming portion, and the retained air exhaust portion is configured to exhaust retained air retained on the liquid adhering surface of the sheet of non-permeable base material to outside of the air shield zone forming portion via a Coanda effect, to thereby replace liquid adhering surface air on the liquid adhering surface of the sheet non-permeable base material; and a conduction and convection portion provided in the air shield zone forming portion, wherein the retained air exhaust portion is an exhaust portion configured to perform removal and replacement of a solvent that is evaporated and convected to a final portion of the air shield zone forming portion.

10. The printing apparatus according to claim 9, wherein the surface drying device further comprises a circumferential surface configured to extend about a circumferential portion of the non-permeable base material in a circumferential direction.

11. The printing apparatus according to claim 10, wherein the retained air exhaust portion is located between the unloading port and the loading port in the circumferential direction.

12. The printing apparatus according to claim 10, wherein the retained air exhaust portion is located between the unloading port and the air nozzle in the circumferential direction.

13. The printing apparatus according to claim 10, wherein the loading port is located at a circumferentially spaced location from the unloading port.

14. A printing method, comprising:

drying an ink adhering surface of a sheet of non-permeable base material having ink adhering thereto via a surface drying device for the sheet of non-permeable base material, the surface drying device comprising:

a loading port for loading the sheet of non-permeable base material with a liquid adhering surface having a liquid adhering to a surface thereof;

an air nozzle configured to spray high-temperature air onto the liquid adhering surface of the sheet of non-permeable base material loaded;

an unloading port for unloading the sheet of non-permeable base material;

an air shield zone forming portion, which is formed between the loading port and the unloading port, and the air shield zone forming portion is configured to form a heat-insulating air shield so as to cover the liquid adhering surface of the sheet of non-permeable base material;

a retained air exhaust portion, which is formed in the air shield zone forming portion, and the retained air exhaust portion is configured to exhaust retained air retained on the liquid adhering surface of the sheet of non-permeable base material to outside of the air shield zone forming portion via a Coanda effect, to thereby replace liquid adhering surface air on the liquid adhering surface of the sheet non-permeable base material; and a conduction and convection portion provided in the air shield zone forming portion, wherein the retained air exhaust portion is an exhaust portion configured to perform removal and replacement of a solvent that is evaporated and convected to a final portion of the air shield zone forming portion.

15. The printing method according to claim 14, wherein the surface drying device further comprises a circumferential surface configured to extend about a circumferential portion of a roller in a circumferential direction.

16. The printing method according to claim 15, wherein the retained air exhaust portion is located between the unloading port and the loading port in the circumferential direction.

17. The printing apparatus according to claim 15, wherein the retained air exhaust portion is located between the unloading port and the air nozzle in the circumferential direction.

18. The printing apparatus according to claim 15, wherein the loading port is located at a circumferentially spaced location from the unloading port.

19. A surface drying device for a sheet of non-permeable base material, the surface drying device comprising:

a loading port for loading a sheet of non-permeable base material with an ink adhering surface having an ink adhering to a surface thereof;

an air nozzle configured to spray high-temperature air onto the ink adhering surface of the sheet of non-permeable base material loaded;

an unloading port for unloading the sheet of non-permeable base material;

an air shield zone forming portion, which is formed between the loading port and the unloading port, and the air shield zone forming portion is configured to form a heat-insulating air shield so as to cover the ink adhering surface of the sheet of non-permeable base material;

a retained air exhaust portion, which is formed in the air shield zone forming portion, and the retained air exhaust portion is configured to exhaust retained air retained on the ink adhering surface of the sheet of non-permeable base material to outside of the air shield zone forming portion via a Coanda effect, to thereby replace ink adhering surface air on the ink adhering surface of the sheet non-permeable base material; and a conduction and convection portion provided in the air shield zone forming portion, wherein the retained air exhaust portion is an exhaust portion configured to perform removal and replacement of a solvent that is evaporated and convected to a final portion of the air shield zone forming portion, the loading port and the unloading port defining at least a portion of a circumferential guide path of the non-permeable base material, wherein the loading port, the air nozzle, the unloading port, the air shield zone forming portion, the retained air exhaust portion and the conduction and convection portion are arranged along the circumferential guide path.

20. The surface drying device for the sheet of non-permeable base material according to claim 19, wherein the retained air exhaust portion is located between the unloading port and the loading port in a circumferential direction of the circumferential guide path.

* * * * *